United States Patent [19]

Parker et al.

[11] 3,945,434

[45] Mar. 23, 1976

[54] GAS TURBINE HEAT EXCHANGER APPARATUS

[75] Inventors: Kenneth O. Parker, Rolling Hills Estates; Clarence L. Marksberry, Encinitas, both of Calif.

[73] Assignee: The Garrett Corporation, Los Angeles, Calif.

[22] Filed: Sept. 30, 1974

[21] Appl. No.: 510,344

[52] U.S. Cl. ..... 165/166

[51] Int. Cl.[2] ..... F28F 3/06

[58] Field of Search ..... 60/39.50; 165/4, 10, 134, 165/5, 166

[56] References Cited

UNITED STATES PATENTS

| | | | |
|---|---|---|---|
| 1,699,987 | 1/1929 | Parsons | 165/134 |
| 2,606,007 | 8/1952 | Simpelaar | 165/166 |
| 2,952,445 | 9/1960 | Ladd | 165/166 |
| 3,322,189 | 5/1967 | Tobouzian | 165/10 |
| 3,460,611 | 8/1969 | Fulsom et al. | 165/166 |
| 3,703,925 | 11/1972 | Ireland | 165/151 |

*Primary Examiner*—Charles J. Myhre
*Assistant Examiner*—Theophil W. Streule, Jr.
*Attorney, Agent, or Firm*—Alfons Valukonis; Joel D. Talcott; Albert J. Miller

[57] ABSTRACT

Heat exchanger apparatus for a gas turbine which is provided with a heat exchanger of the formed plate counterflow type including a core having a gas turbine exhaust gas inlet surface with integral air outlet manifolds, and an inlet gas temperature controller which controls the temperature of the gas impinging on the manifolds and core surface. The temperature controller consists of a housing defining a gas flow path to the heat exchanger core surface, fluid passages within the housing which direct the gas at substantially full gas temperature onto the manifolds, and heat absorber structure within the housing which absorbs heat from the gas to reduce the temperature to less than full gas temperature during transient conditions, such as turbine start-up, and directs the gas onto the core surface.

5 Claims, 8 Drawing Figures

GAS TURBINE HEAT EXCHANGER APPARATUS

BACKGROUND OF THE INVENTION

This invention relates generally to heat exchanger apparatus and more particularly to gas turbine heat exchanger apparatus.

Gas turbine engines generally use heat exchangers to recover some of the heat of the turbine exhaust gases for transfer to the compressor discharge air before it enters the turbine combustion chamber, which provides for greater fuel economy. However, during turbine start-up conditions, for example, the turbine exhaust gases can reach very high temperatures which can cause very high thermal gradients between the exhaust gas inlet surface and the outlet surface of the heat exchanger core, producing thermal stresses resulting in splitting and cracking of the core. In order to eliminate such a disadvantage some prior heat exchanger apparatus included a heat sink positioned ahead of the heat exchanger core gas inlet surface in the path of flow of the turbine exhaust gases which temporarily reduced the gas temperature, preventing thermal gradients during engine start-up. However, use of such a heat sink, though reducing the gas inlet surface temperature of the heat exchanger core, also undesirably reduced the temperature of gas impinging on air outlet manifolds conveying the compressor discharge air, thus lowering fuel economy.

Examples of prior art heat exchange devices are disclosed in the following U.S. Pat. Nos. 2,492,788 to Dennis; U.S. Pat. No. 2,891,774 to Theoclitres; U.S. Pat. No. 3,263,744 to MacKeown; U.S. Pat. No. 3,289,743 to Biro; U.S. Pat. No. 3,322,189 to Topouzian; U.S. Pat. No. 3,326,214 to McCoy; U.S. Pat. No. 3,507,115 to Wosika; and U.S. Pat. No. 3,528,783 to Haseldon.

SUMMARY OF THE INVENTION

In accordance with the present invention, there is provided heat exchanger apparatus wherein a thermal buffer reduces the exhaust gas temperature impinging on the gas inlet surface of the heat exchanger core, but maintains the gas impinging on the air outlet manifolds at full gas temperature during transient conditions such as turbine start-up.

In the preferred embodiment of the invention, there is provided a heat exchanger of the formed plate counterflow type including a core having a gas inlet surface with integral air outlet manifolds, and means controlling gas temperature distribution across the core gas inlet surface and manifolds during transient gas turbine conditions.

It will be seen that the heat exchanger apparatus of the present invention includes a thermal capacitor which provides preferential temperature distribution upon the gas inlet surface and manifolds of a gas turbine heat exchanger of the formed plate type, resulting in a more uniform skin temperature distribution on the gas inlet surface. The thermal capacitor has the capability of reducing the gas transient temperature as it impinges on the gas inlet surface at full buffer capacity. The thermal capacitor reduces the gas temperature on portions of the manifolds, but on selected portions of the manifolds allows the gas to impinge thereon at full gas temperature.

BRIEF DESCRIPTION OF THE DRAWINGS

For a more complete understanding of the invention, reference may be had to the accompanying drawings in which.

DESCRIPTION OF THE PREFERRED EMBODIMENT

Figure 1:
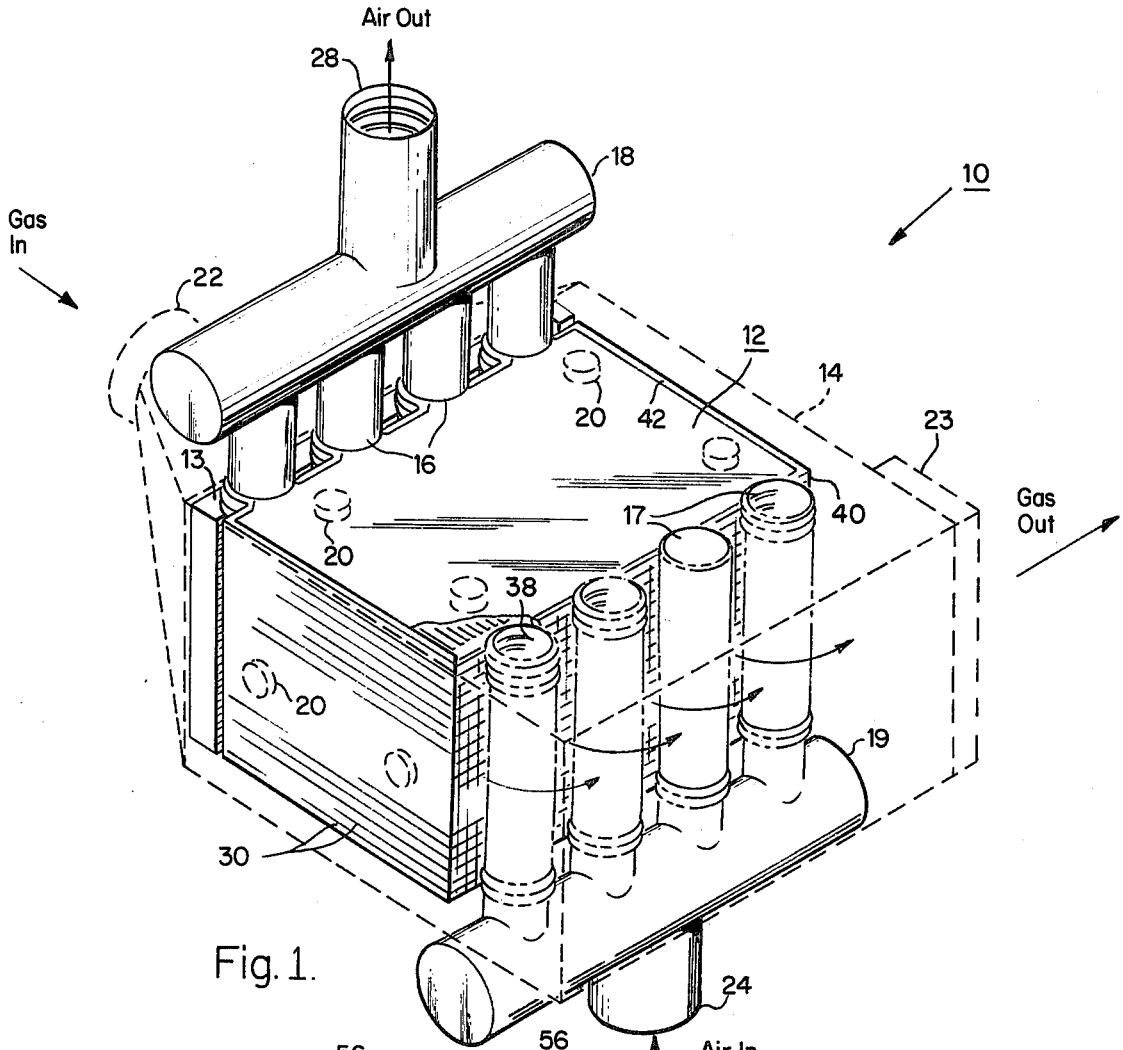
FIG. 1 is a persepective view of heat exchanger apparatus embodying the present invention.

FIG. 1 illustrates a heat exchanger 10 incorporating the present invention which has a core 12 and a hot inlet gas temperature controller or thermal buffer 13 enclosed with a housing 14. The core 12 is provided with integrally positioned manifolds 16, 17 on opposite hot gas inlet and outlet end surfaces and connected respectively to headers 18, 19. The heat exchanger core 12 is supported within housing 14 by mounts 20. Controller 13 is also supported within the housing by similar mounts 20. Housing 14 is provided with inlet and outlet passages 22 and 23 for passing a hot gas through the heat exchanger core 12 an intimate heat exchange relationship with air flowing between the respective manifolds 16, 17. Air enters header 19 through an inlet pipe 24 which may incorporate a load compensating bellows portion (not shown) to adjust for dimensional variation. Header 18 is provided with an outlet pipe 28 which may also be provided with a load compensating bellows portion.

Figure 2:
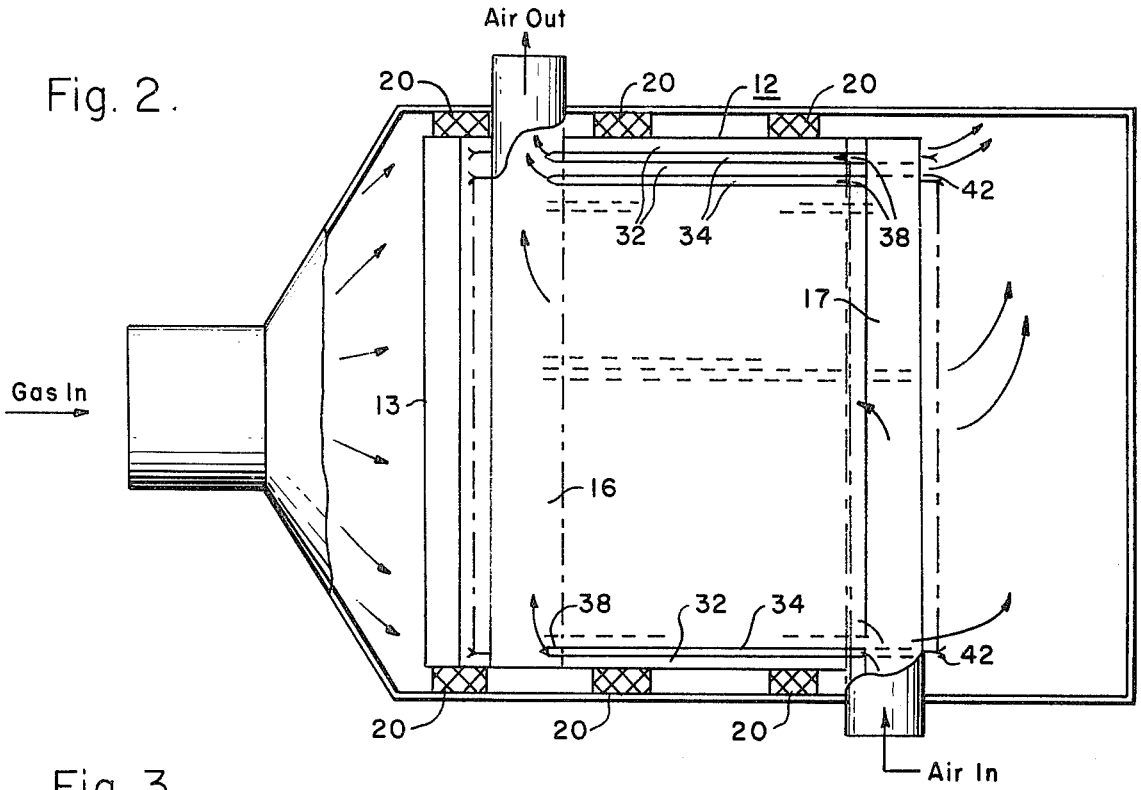
FIG. 2 is a sectional elevation view of FIG. 1.
Figure 3:
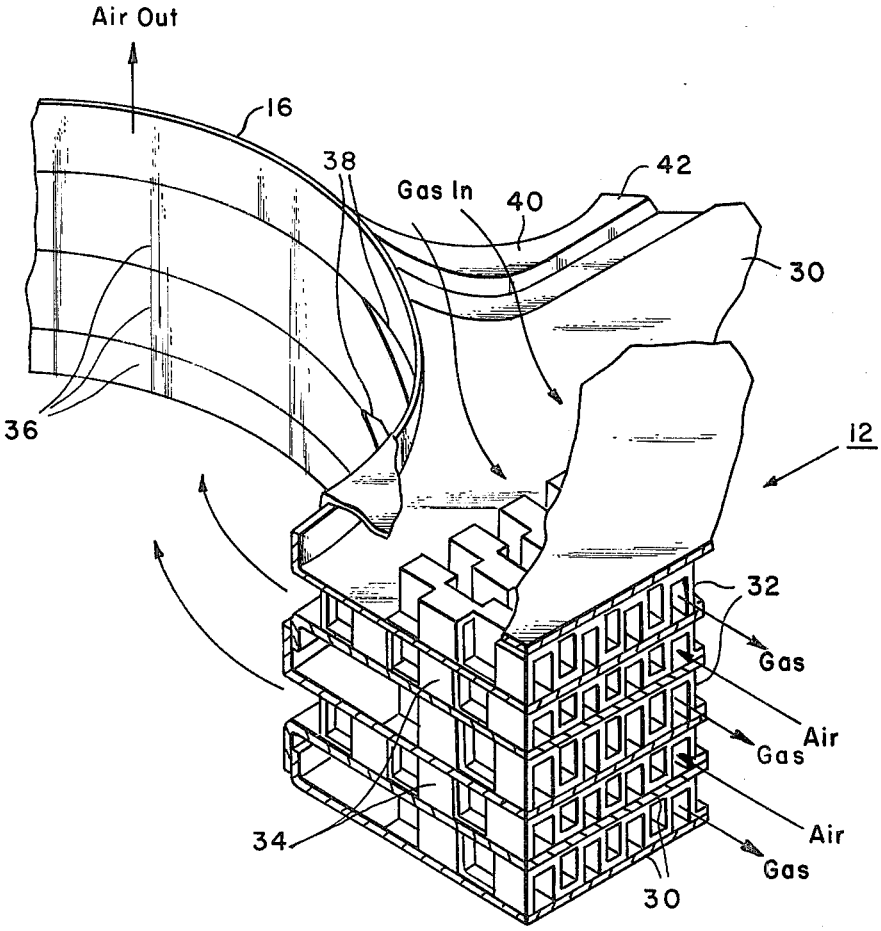
FIG. 3 is a perspective sectional view of a portion of FIG. 1.

Reference is now made to FIGS. 2 and 3 wherein further details of the heat exchanger 10 are illustrated. The core section 12 includes a plurality of formed plates 30 sandwiched together with and separated from each other by respective layers of gas fins 32 and air fins 34. The formed plates 30 are provided with collars 36 to envelop the manifold 16 extending into the sandwiched structure and define strategically located openings 38 for passing air between the manifold 16 and the air fins 34. Correspondingly, openings are provided at 40 for the passage of hot gases from the outside of the core 12 to the gas passages containing the gas fins 32. Thus, as may be seen from FIG. 3, the respective gas and air fin configurations within the sandwich structure of the core 12 serve to provide a certain rigidity and integrity to the structure while at the same time serving to provide the desired heat transfer between the adjacent gas and air streams while developing the desired turbulence in the respective fluid flows so as to enhance the heat transfer characteristics of the fluid-metal interface.

Figure 4:
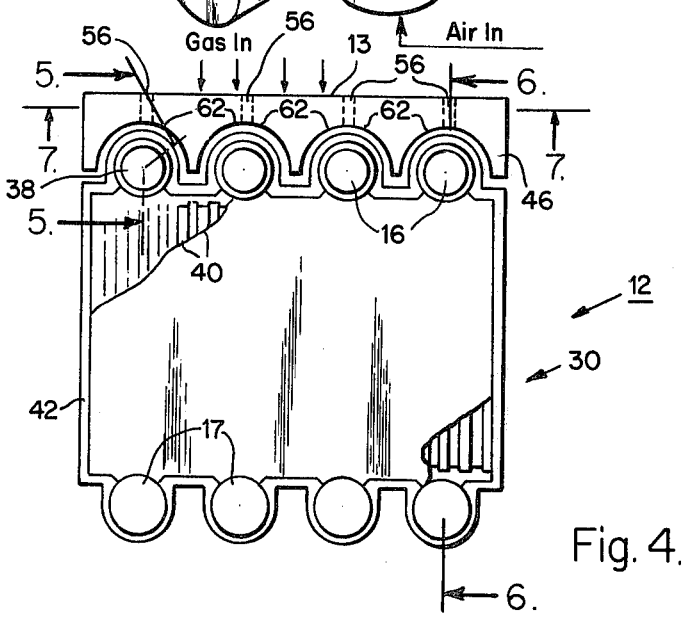
FIG. 4 is a plan view of the heat exchanger core and gas temperature controller of FIGS. 1 and 2.
Figure 5:
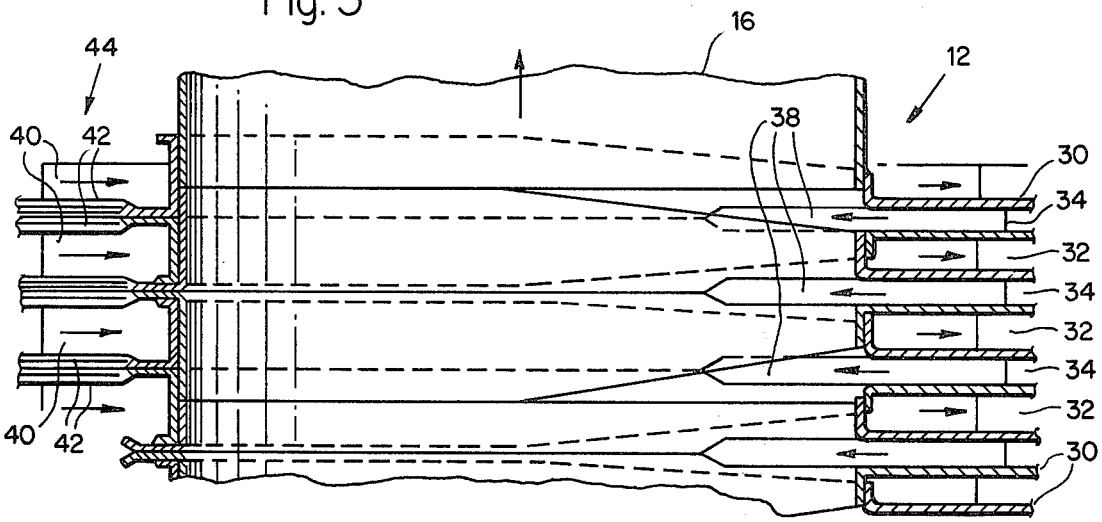
FIG. 5 is a sectional view taken along the lines 5—5 of FIG. 4.

FIG. 4 may be considered a plan view of the core 12 and heat absorber 13 of FIG. 1. It may also be considered as representing in general outline form one of the formed plates 30 making up the core 12. As may be seen, the plate 30 is provided with an offset flange 42 extending about its periphery. This offset flange is for the purpose of joining to a similar flange on the plate of the next layer in the stack so as to define a fluid passage having openings communicating therewith only as indicated hereinabove; i.e. where the fluid passage is an air stream, openings communicating with the manifolds 16 and 17, whereas for a gas stream the openings communicate with the outside of the core 12 at segments between adjacent manifolds 16 or 17. Such a segment may be seen at 44 on the left-hand side of FIG. 5, which is a section of a portion of the core 12 taken along the line 5—5 of FIG. 4 looking in the direction of the arrows. Gas openings 40 and the juncture of adjacent flanges 42 are shown in segment 44 of FIG. 5. Air openings 38 are shown in FIG. 5 on the opposite side of the manifold 16 and communicating therewith.

Figure 6:
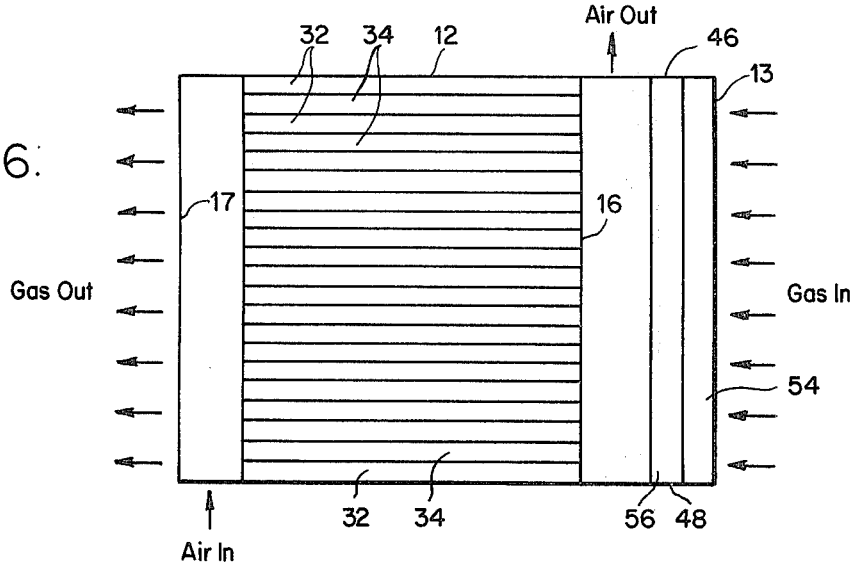
FIG. 6 is a cross-sectional view taken along the lines 6—6 of FIG. 4.
Figure 7:
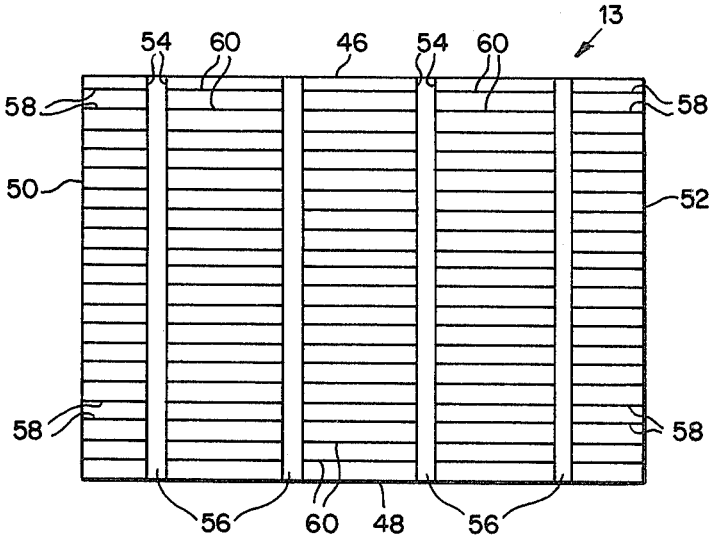
FIG. 7 is a cross-sectional view taken along the lines 7—7 of FIG. 4.
Figure 8:
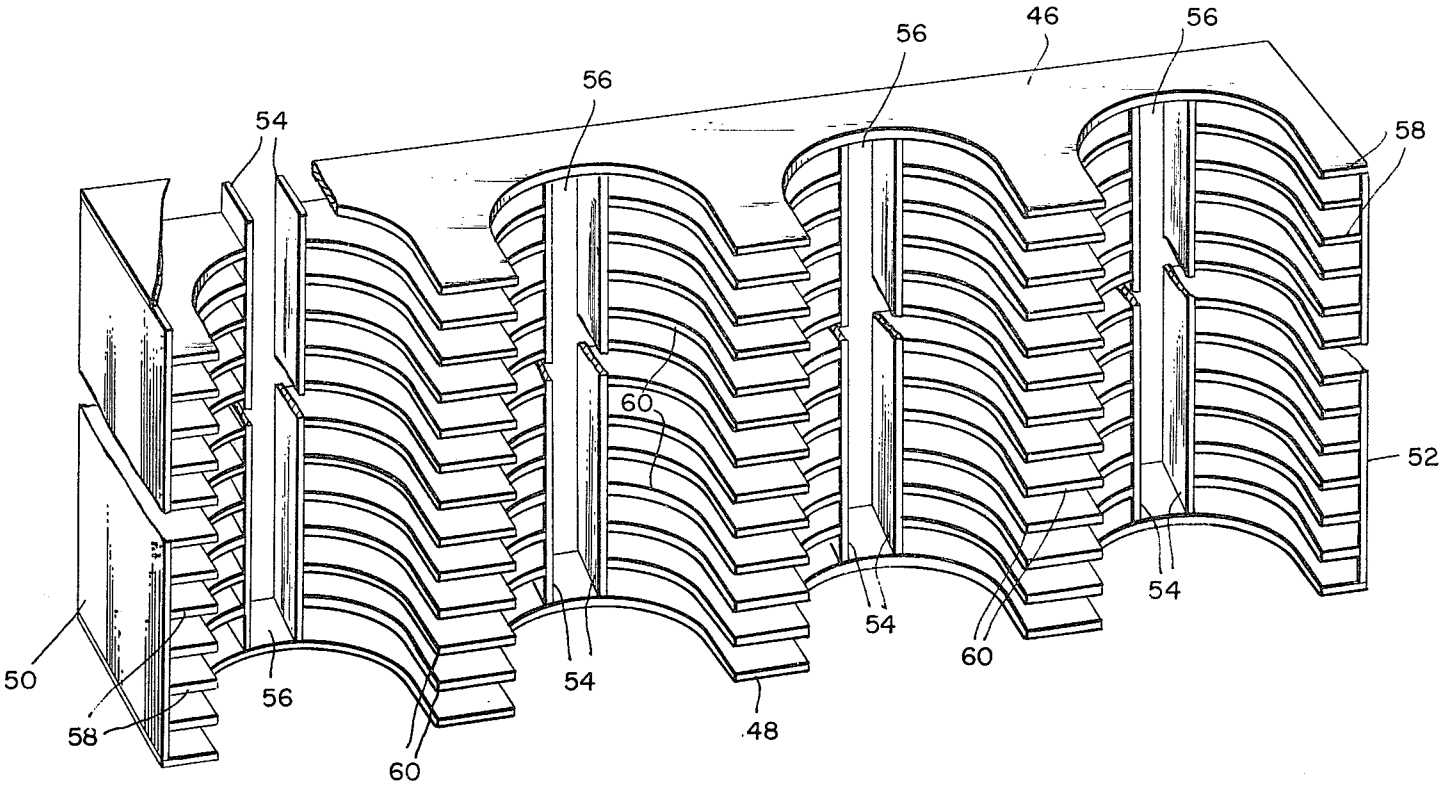
FIG. 8 is an enlarged, partial, perspective view of the temperature controller of FIG. 4.

Reference is made to FIGS. 6, 7 and 8 wherein the details of the thermal capacitor or hot gas temperature controller 13 are illustrated. Controller 13 is provided with a generally rectangularly shaped housing having top, bottom, and side metal plate members 46, 48, 50 and 52, respectively, secured together at their end edges as by welding to define a flow path for the hot inlet gas. Pairs of intermediate plate members 54 are secured at their end edges to the top and bottom plate members 46, 48 to define fluid passages 56 for directing flow of portions of the hot exhaust gas onto the air outlet manifolds 16 of the hot gas inlet surface of core 12 at full gas temperature. Similar groups of stacked, spaced plate members 58, arranged in generally parallel planes, are secured between side members 50, 52 and intermediate plate members 54. Also provided, arranged in parallel planes, stacked, and spaced, are other similar groups of plate members 60 secured intermediate the plate members 54. Plates 58 and 60 serve to absorb heat from the remaining portions of the hot inlet gas directed onto the rest of the gas inlet surface of core 12 to lower the temperature of the gas.

Top and bottom plate members 46 and 48 are identical, generally of rectangular shape, substantially as long as the width of heat exchanger core 12, and generally arranged substantially parallel to each other. The plate members 46 and 48 have corresponding straight side edges and opposing scalloped edges with generally semi-circular shaped cut-outs 62 serving to envelope the air outlet manifolds 16, and generally conforming to the hot gas inlet surface of core 12.

Intermediate plate members 54 are secured at their ends in vertical, parallel pairs, substantially perpendicular to the top and bottom plate members 46, 48, intermediate their straight side edges and cut-outs 62, to define the vertically disposed passages 56, opposed to the respective air outlet manifolds 16, for directing hot gas over substantially their entire lengths.

Plate members 60 are provided with cut-outs 66 at opposite corners conforming generally to the surface configuration of a manifold 16.

In operation, during turbine start-up, for example, air enters header 19 through inlet pipe 24 passes into manifolds 17 and then into the air flow passages in the heat exchanger core 12. The air then flows upward through manifolds 16 into header 18 and out through outlet pipe 28. At the same time hot turbine exhaust gas flows into housing 14 through inlet duct 22 through passages 56 of controller 13, impinges directly on the air outlet manifolds 16 at the full gas temperature, and then flows around the manifolds 16, and through the gas flow passages of the core 12 and out the outlet passage 23. At the same time hot gas flows between the plates 58 and 60 of controller 13 wherein heat is absorbed to temporarily reduce the temperature of the gas to a temperature less than the full gas temperature of the gas, and then also through the gas flow passages sandwiched between the air flow passages of the core 12.

While a specific embodiment of the invention has been illustrated and described, it is to be understood that it is provided by way of example only and that the invention is not to be construed as being limited thereto, but only by the scope of the following claims.

What we claim is:

1. A counterflow heat exchanger of the type including a core of substantially parallel stacked plates and a plurality of manifolds in parallel spaced relation to each other, said manifolds and said defining a gas inlet surface for receiving hot gases and directing said gases into alternate spaces between said plates and temperature controller means, the improvement wherein said temperature controller means comprises:

a body having an inlet side and an outlet side and including a plurality of plate members defining a plurality of gas passages communicating said inlet side and said outlet side, said inlet side being arranged for receiving said hot gases and said outlet side being in close proximity to said gas inlet surface;

first ones of said passages being arranged for conducting a portion of the hot gases to said stacked plates of said heat exchanger and including means reducing the temperature of the hot gases before such gases reach said stacked plates of said heat exchanger, and second ones of said passages bypassing said first passages and being arranged for conducting the remainder of said hot gases into heat transmitting relationship with said manifolds so that hot gases from said second passages which heat said manifolds are at a higher temperature than the gases leaving said first passages during transient heat exchange conditions.

2. A counterflow heat exchanger according to claim 1 wherein said passage-defining plate members of said temperature controller body include a series of vertically spaced horizontal plate members which define said first passages and which comprise said temperature reducing means of said temperature controller means, and a plurality of horizontally spaced vertical plates which define said second passages.

3. A counterflow heat exchanger according to claim 2 wherein said horizontal plates have cut-outs which receive said manifolds.

4. A counterflow heat exchanger according to claim 3 wherein said stacked plates extend horizontally and said manifolds constitute air outlet manifolds of said heat exchanger.

5. A counterflow heat exchanger according to claim 3 wherein there are a plurality of pairs of said vertical plate members spaced along the horizontal length of said temperature controller ahead of said cut-outs so that said second passages are situated in front of and in alignment with said manifolds.

* * * * *

UNITED STATES PATENT AND TRADEMARK OFFICE

CERTIFICATE OF CORRECTION

PATENT NO. : 3,945,434

DATED : March 23, 1976

INVENTOR(S) : Kenneth O. Parker; Clarence L. Marksberry

It is certified that error appears in the above-identified patent and that said Letters Patent are hereby corrected as shown below:

Column 4, line 18, after "said" (second occurrence), insert --core--.

Add the reference numeral --66-- to Fig. 8 to appear as follows:

Fig. 8.

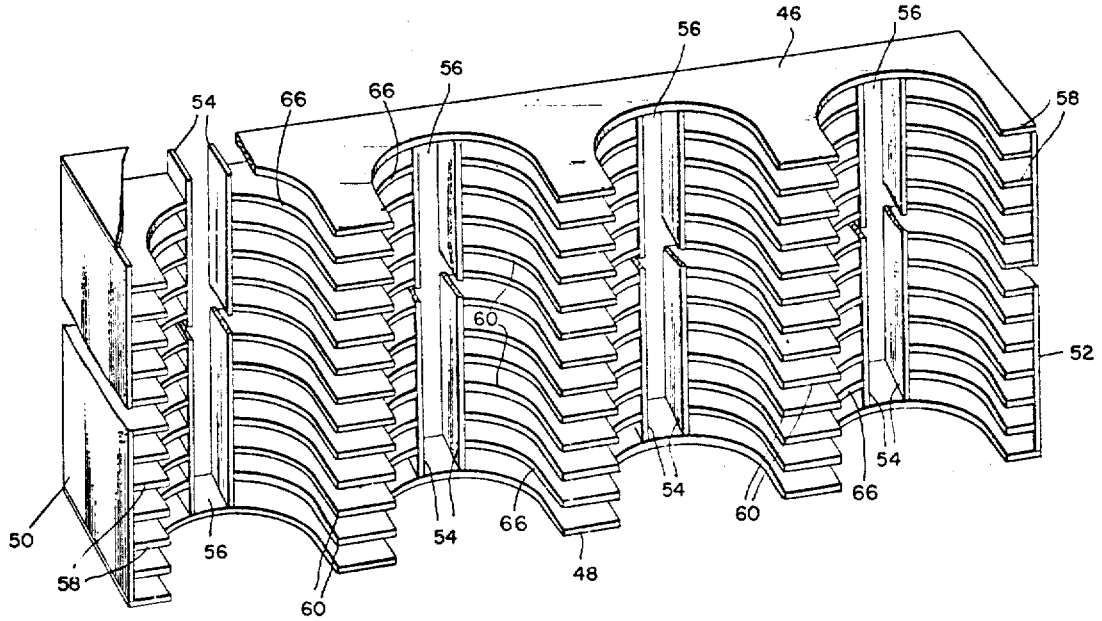

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*